US009163637B2

(12) United States Patent
Hsieh

(10) Patent No.: US 9,163,637 B2
(45) Date of Patent: Oct. 20, 2015

(54) FAN ASSEMBLY AND FAN DEVICE THEREOF

(75) Inventor: Sheng-Jen Hsieh, Taoyuan Hsien (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 755 days.

(21) Appl. No.: 13/342,979

(22) Filed: Jan. 4, 2012

(65) Prior Publication Data

US 2012/0257999 A1 Oct. 11, 2012

(30) Foreign Application Priority Data

Apr. 8, 2011 (TW) ..... 100112151 A

(51) Int. Cl.
*F04D 29/52* (2006.01)
*F04D 25/06* (2006.01)
*F04D 29/64* (2006.01)

(52) U.S. Cl.
CPC ..... *F04D 25/0613* (2013.01); *F04D 25/0693* (2013.01); *F04D 29/522* (2013.01); *F04D 29/64* (2013.01)

(58) Field of Classification Search
CPC . F04D 25/166; F04D 25/0693; F04D 29/601; F04D 29/64; F04D 29/522; H05K 7/20172
USPC ..... 417/423.14; 415/213.1; 361/695; 439/485
See application file for complete search history.

(56) References Cited

U.S. PATENT DOCUMENTS 5,344,332 A * 9/1994 Lopez et al. ..... 439/248
6,074,296 A * 6/2000 Wu ..... 454/184
6,190,197 B1 * 2/2001 Polgar et al. ..... 439/527
6,373,698 B1 * 4/2002 Christensen ..... 361/695
6,375,440 B2 * 4/2002 Kosugi ..... 417/423.14
6,431,910 B1 * 8/2002 Chuang et al. ..... 439/577
6,435,889 B1 * 8/2002 Vinson et al. ..... 439/247
6,493,225 B2 * 12/2002 Chuang et al. ..... 361/695
6,556,437 B1 * 4/2003 Hardin ..... 361/679.48
6,592,327 B2 * 7/2003 Chen et al. ..... 415/213.1
6,690,576 B2 * 2/2004 Clements et al. ..... 361/695
6,808,411 B2 * 10/2004 Chen ..... 439/485
6,817,889 B2 * 11/2004 Chang et al. ..... 439/485
7,048,498 B2 * 5/2006 Kosugi ..... 415/118
7,230,826 B2 * 6/2007 Kyle et al. ..... 361/695
7,251,135 B2 * 7/2007 Crippen et al. ..... 361/695
7,304,843 B2 * 12/2007 Peng et al. ..... 361/679.48
7,537,480 B2 * 5/2009 Li ..... 439/485
7,572,100 B2 * 8/2009 Strohm ..... 415/213.1
7,597,571 B2 * 10/2009 Chen et al. ..... 439/173
7,641,441 B2 1/2010 Chuang
7,791,880 B2 * 9/2010 Chen et al. ..... 361/695
8,246,301 B2 * 8/2012 Li ..... 415/213.1
8,405,988 B2 * 3/2013 Wang ..... 361/695
8,517,678 B2 * 8/2013 Li ..... 415/213.1

(Continued)

FOREIGN PATENT DOCUMENTS

TW M355307 U 4/2009

*Primary Examiner* — Devon Kramer
*Assistant Examiner* — Nathan Zollinger
(74) *Attorney, Agent, or Firm* — CKC & Partners Co., Ltd.

(57) ABSTRACT

A fan assembly and its fan device are provided. The fan device includes a housing, a fan body disposed in the housing, a connector electrically connected with the fan body, and a fixing cover detachably assembled to the housing. The fixing cover includes a connecting structure fitting a type of the connector for positioning the connector on the fixing cover.

15 Claims, 8 Drawing Sheets

(56) References Cited

U.S. PATENT DOCUMENTS 8,727,750 B2 * 5/2014 Lu et al. ..... 417/423.14
8,807,934 B2 * 8/2014 Tsai et al. ..... 415/213.1
2002/0015648 A1 * 2/2002 Kosugi ..... 417/423.14
2003/0026074 A1 2/2003 Clements et al.
2007/0154300 A1 * 7/2007 Liang ..... 415/119

* cited by examiner

FAN ASSEMBLY AND FAN DEVICE THEREOF

RELATED APPLICATIONS

This application claims priority to Taiwan Application Serial Number 100112151, filed Apr. 8, 2011, which is herein incorporated by reference.

BACKGROUND

1. Technical Field

The present disclosure relates to a heat dissipating device and more particularly to a fan assembly and a fan device thereof.

2. Description of Related Art

In general, electric apparatuses would generate heat when operating. If heat cannot be dissipated efficiently, electric apparatuses may malfunction. In serious situations, electric elements of electric apparatuses may be damaged so as to cause property loss. One of the traditional methods for solving thermal problems of electric apparatuses is to install heat dissipating devices in housings of electric apparatuses, such as utilizing fan devices to dissipate heat generated from operating electric apparatuses. For example, one or several fan devices are usually installed in housings of internet servers or desktop computers, so that heat generated from operating electric apparatuses would be dissipated by a force convection generated from fan devices. Therefore, internet servers or desktop computers would work steadily.

Structures of typical heat dissipating fan devices may need different types of connectors according to different electric apparatuses. Electric elements and control circuits in electric apparatuses have to transmit electric power into fan devices by connectors, and connectors may further be signal transmission media between fan devices and electric apparatuses. In one aspect, connectors can transmit electric power into fan devices. In another aspect, operating statuses of fan devices can be controlled or monitored by connectors with signal wires, such as rotation speed or temperature of fan devices.

In practice, a fan device may further include a housing for fixing a connector on the housing, wherein the connector would connect an external electric apparatus conveniently for providing electric power to the fan device. However, different electric apparatuses may have different connectors. As long as electric apparatuses have different connectors, the fan device needs to have different corresponding connectors. As for conventional techniques nowadays, different connectors have to be installed on different corresponding housings of fan devices, so that housings of fan devices often have to be changed according to different types of connectors. In order to fit different types of connectors, manufacturers may produce new molds for manufacturing new housings. As far as manufacturers are concerned, such housings of fan devices would waste a lot of time and manpower.

Furthermore, because many electric apparatuses are located in a server rack, a side or a back portion of the rack may accommodate a lot of fan devices. Therefore, housings of fan devices may be fastened to the server rack with screws directly. In order to save space, fan devices may also be installed tight within the server rack, i.e. all fan devices in contact with each other. When all impellers of fan devices rotate, such arrangement would not only make a lot of vibration noise, but also reduce lifetime of fan devices because of vibrating.

In addition, when an electric apparatus includes a lot of fan devices, users are difficult to judge statuses of every fan device, such as normal operation or stop. Conventional art may utilize light sources fastened on housings for indicating fan devices' operation status, i.e. operating or not. However, manufacturers have to produce larger housings for accommodating light sources or light guide devices, thereby consuming more materials of housings and accommodating space.

SUMMARY

An aspect of the present invention is to provide a fan device.

In an embodiment of the present invention, a fan device includes a housing, a fan body, a connector, and a fixing cover. The fan body is disposed in the housing. The connector is electrically connected to the fan body. The fixing cover is detachably assembled to the housing, wherein the fixing cover includes a connecting structure fitting a type of the connector for positioning the connector on the fixing cover.

Another aspect of the present invention is to provide a fan assembly.

In an embodiment of the present invention, a fan assembly includes a frame housing, a partition board, and the fan device mentioned above. The partition board is disposed in the frame housing, wherein the partition board includes an opening. The housing of the fan device includes a flexible arm including a protruding portion. The protruding portion faces away from the fan body and is coupled to the opening.

In embodiments mentioned above of the present invention, users can change different types of the fixing covers to fit different types of the connectors, and do not need to change the whole housing due to different connectors, thereby achieving an object of decreasing costs. In addition, the fan assembly can accommodate the fan devices between the partition boards, and the housing includes the protruding portion of the flexible arm to be coupled to the corresponding opening of the partition board. In use, the fan device would be detachably assembled between the frame housing and the partition board conveniently.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1A:
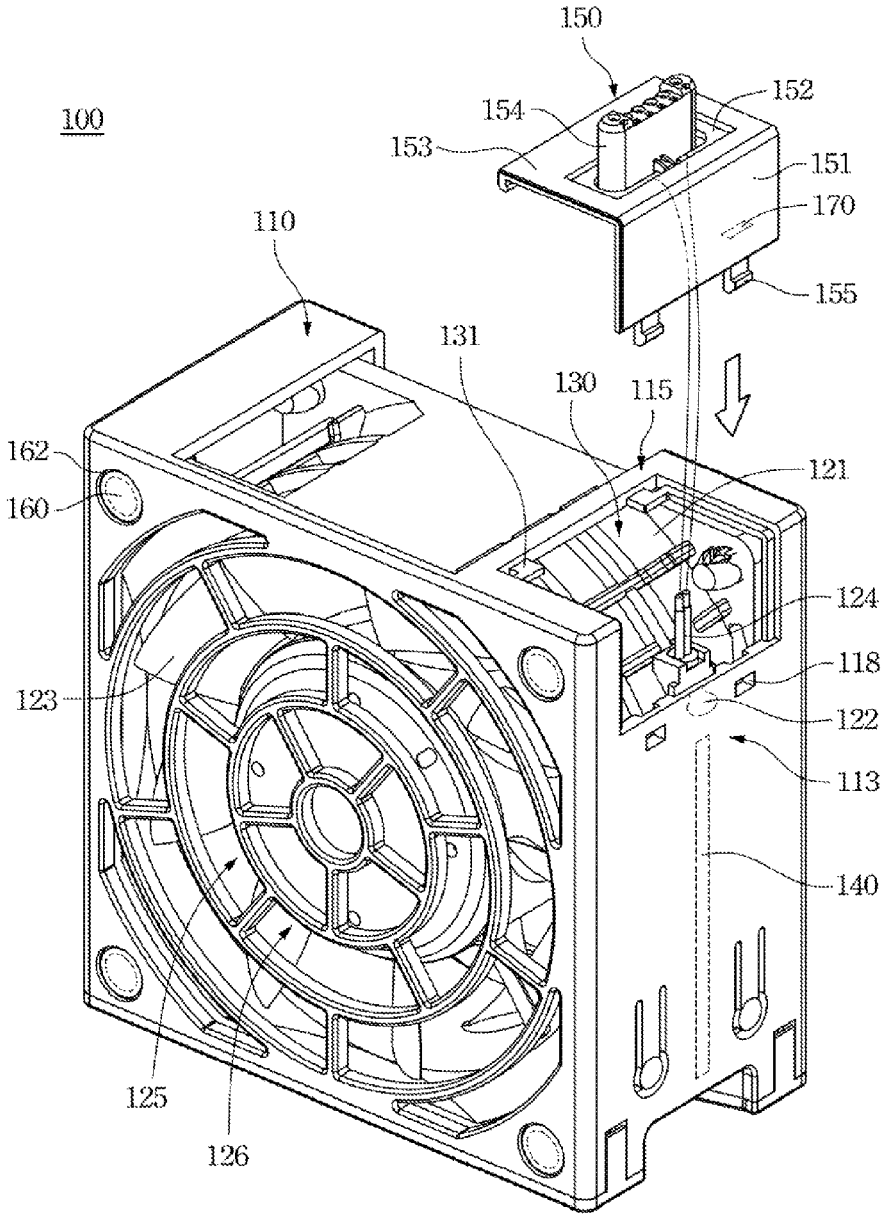
FIG. 1A is a perspective view of a fan device of an embodiment of the present invention.

FIG. 1A is a perspective view of a fan device 100 of an embodiment of the present invention. A fan device 100 includes a housing 110, a fan body 130, a connector 154 and a fixing cover 150. The fan body 130 is disposed in the housing 110. The connector 154 is electrically connected to the fan body 130. The fixing cover 150 is detachably assembled to the housing 110. The fixing cover 150 includes a connecting structure 152 fitting a type of the connector 154 for positioning the connector 154 on the fixing cover 150.

Figure 1B:
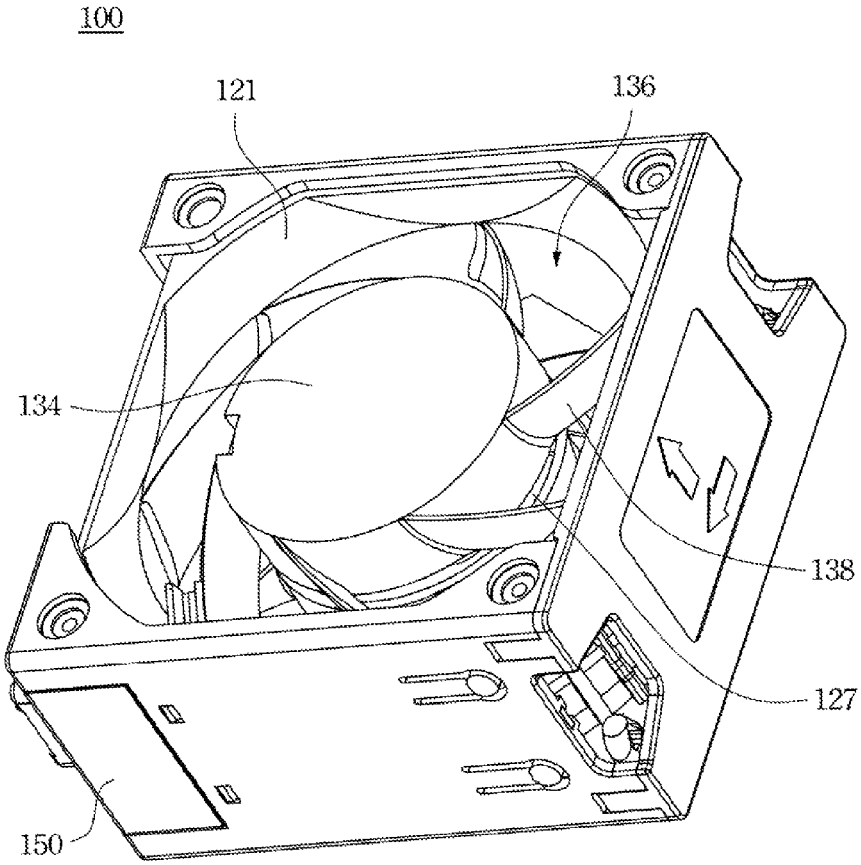
FIG. 1B is a perspective view of a combination of the fixing cover and the housing shown in FIG. 1A.

FIG. 1B is a perspective view of a combination of the fixing cover 150 and the housing 110 shown in FIG. 1A. As shown in FIG. 1A and FIG. 1B, the fan body 130 mentioned above includes a fan frame 121, an impeller 123 accommodated in the fan frame 121, a motor 127 for driving the impeller 123 to rotate, a bottom portion 134 for supporting the motor 127, and connecting members 138 for connecting the fan frame 121 and the bottom portion 134. The connecting member 138 may be a rib or a static blade. The fan frame 121 includes a wind inlet side 125 and a wind outlet side 136. The connecting members 138 are disposed on the wind outlet side 136 of the fan frame 121.

Figure 1C:
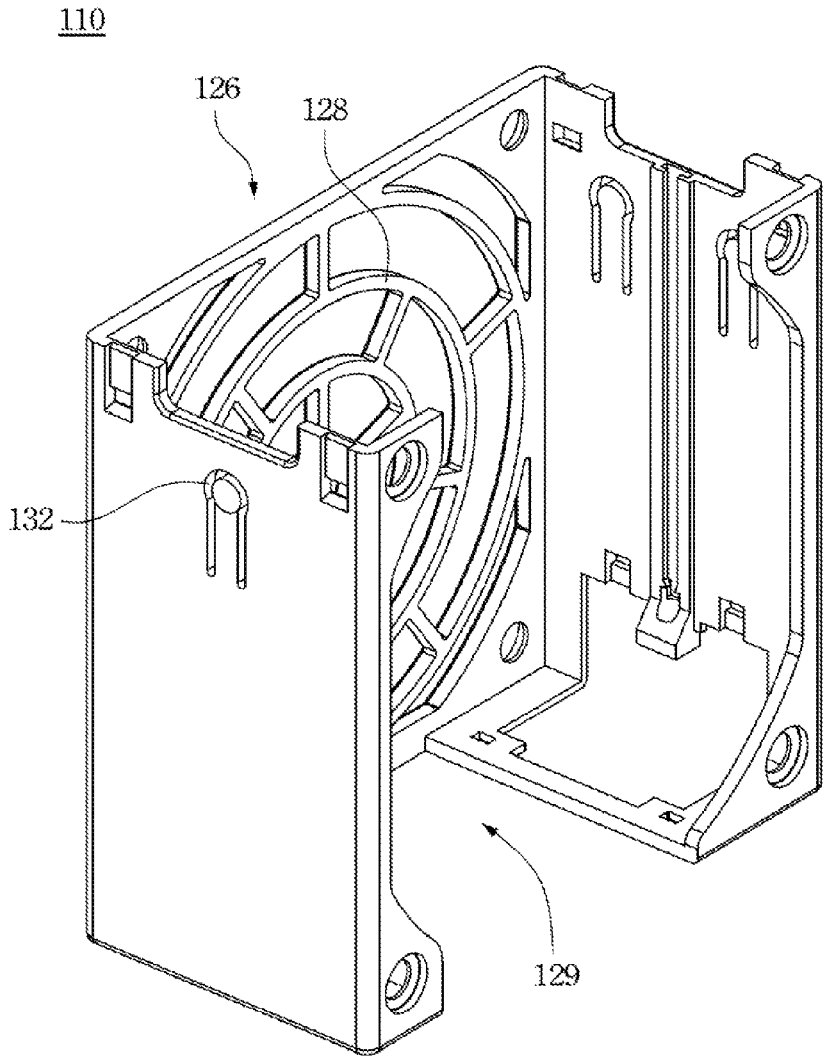
FIG. 1C is a perspective view of the housing shown in FIG. 1A.

FIG. 1C is a perspective view of the housing 110 shown in FIG. 1A. As shown in FIG. 1A to FIG. 1C, the housing 110 includes a wind inlet opening 126 and a wind outlet opening 129 corresponding to the wind inlet side 125 and the wind outlet side 136 of the fan body 110 respectively. The housing 110 includes at least one protecting rib 128 disposed on the wind inlet opening 126 for preventing external objects from entering the fan body 130, so that external objects would not affect rotation of the impeller 123.

The fan body 130 includes a connector 154 electrically connected with the fan body 130 for receiving electric power or signal transmission generated from external electric apparatuses (not shown), such as rotation speed or/and temperature of the fan body 130 when operating.

Figure 1D:
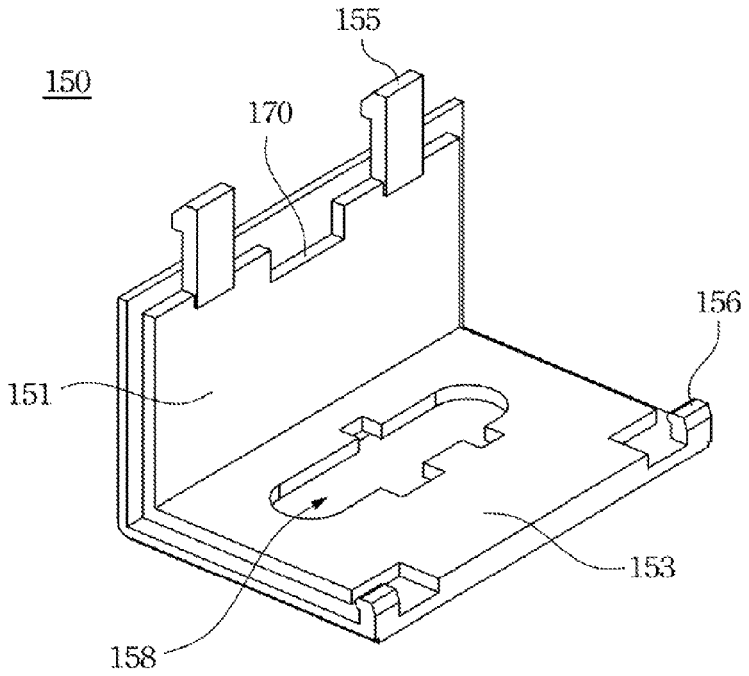
FIG. 1D is a perspective view of the fixing cover shown in FIG. 1A.
Figure 1E:
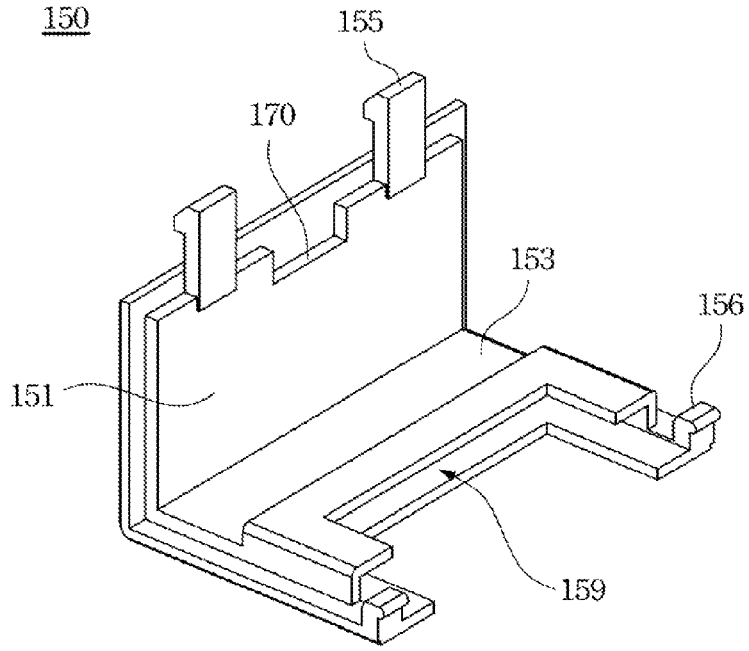
FIG. 1E is a perspective view of the fixing cover of another embodiment shown in FIG. 1D.

FIG. 1D is a perspective view of the fixing cover 150 shown in FIG. 1A, FIG. 1E is a perspective view of the fixing cover 150 of another embodiment shown in FIG. 1D. As shown in FIG. 1A, FIG. 1D, and FIG. 1E, the fixing cover 150 is disposed on a corner of the housing 110. In use, the fixing cover 150 can be assembled to the housing 110 or removed from the housing 110, wherein the fixing cover 150 includes at least one hook, and the housing 110 includes at least one groove, so that the hook would be coupled to the groove for assembling the fixing cover 150 on the housing 110. However, the fixing cover 150 also can be assembled to the housing 110 by other methods, such as using fasteners or screws to fix. In practice, the fixing cover 150 includes a first board 151 and a second board 153 vertically arranged with each other. The first board 151 is coupled to a first surface 113 of the housing 110 to form a plane. The second board 153 is coupled to a second surface 115 of the housing 110 to form another plane. The first board 151 includes at least one first hook 155 for being coupled to a first groove 118 of the first surface 113 with each other, and the second board 153 includes at least one second hook 156 for being coupled to a second groove 131 of the second end surface 115 with each other.

The fixing cover 150 includes the connecting structure 152 fitting the type of the connector 154, so that the connector 154 can be disposed on the fixing board 150 and electrically connected to external electric apparatuses conveniently. The connecting structure 152 may be a part of the fixing cover 150, such as a surface of the fixing cover 150 or a hollow region of a surface of the fixing cover 150. The connecting structure 152 preferably is an opening hole 158 (shown in FIG. 1D) or a concave 159 (shown in FIG. 1E). Types of the connectors 154 may have two pins to eight pins. Different external electric apparatuses may have different interfaces of the connectors 154. In use, the type of the fixing cover 150 can be chosen in accordance with the type of the connector 154, and no need to change the whole housing 110 due to different connectors 154.

Figure 2:
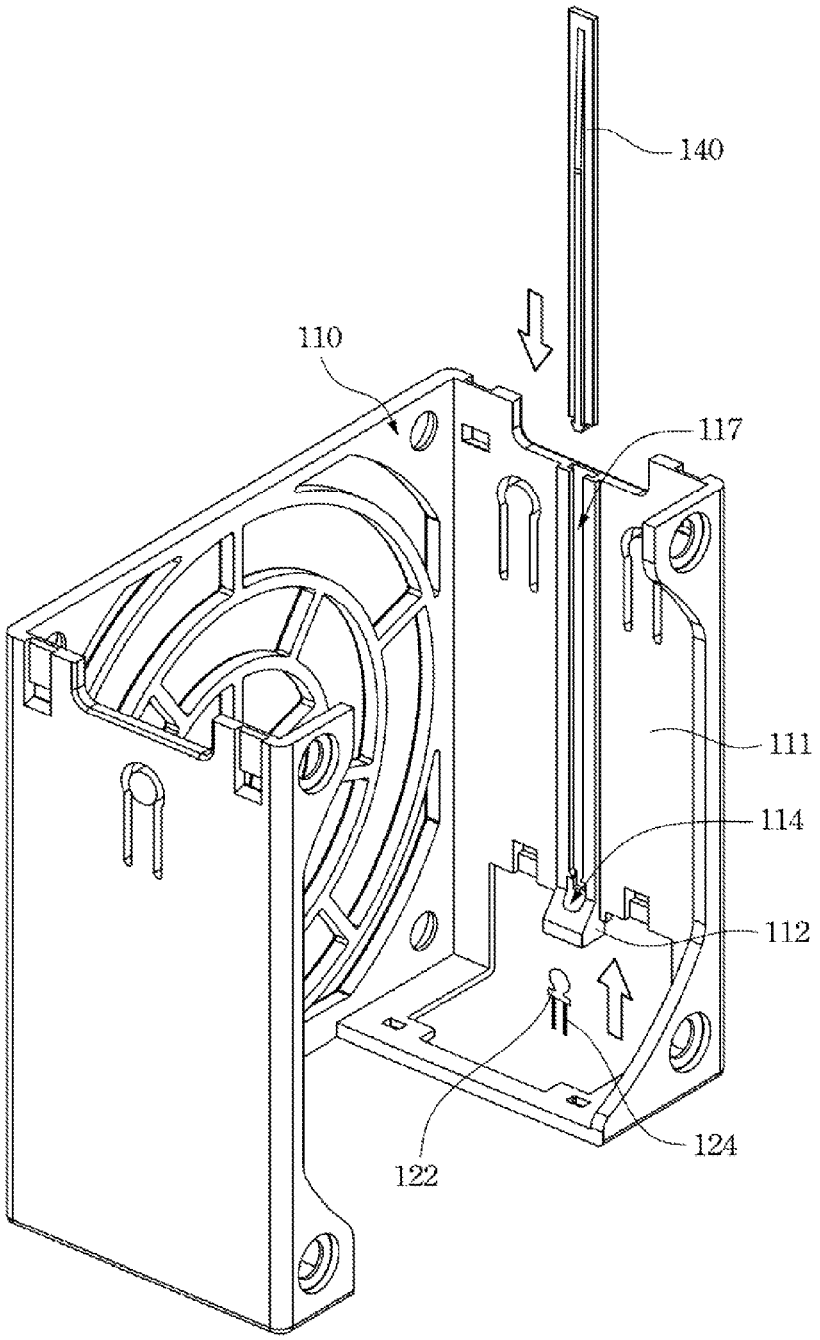
FIG. 2 is an internal perspective view of the housing shown in FIG. 1A.

FIG. 2 is an internal perspective view of the housing 110 shown in FIG. 1A. As shown in FIG. 1A and FIG. 2, the fan device 100 further includes a accommodating groove 117, a light source 122 (e.g. a light emitting diode), and a light guide pillar 140. The accommodating groove 117 is disposed on an internal wall 111 of the housing 110. The light source 122 is disposed at an end of the accommodating groove 117 adjacent to the fixing cover 150. The light guide pillar 140 is disposed in the accommodating groove 117. In this embodiment, because the light source 122 is adjacent to the fixing cover 150, an electric wire 124 disposed on the bottom surface of the light source 122 would be connected to the connector 154 easily. The light emitted from the light source 122 would be guided away from the fixing cover 150 by the light guide pillar 140, and such design can prevent the light emitted from the light source 122 from shielding due to the connector 154 or the fixing cover 150. Furthermore, because the accommodating groove 117 is disposed on the internal wall 111 of the housing 110, disposing space of the light guide pillar 140 can be saved.

Figure 3:
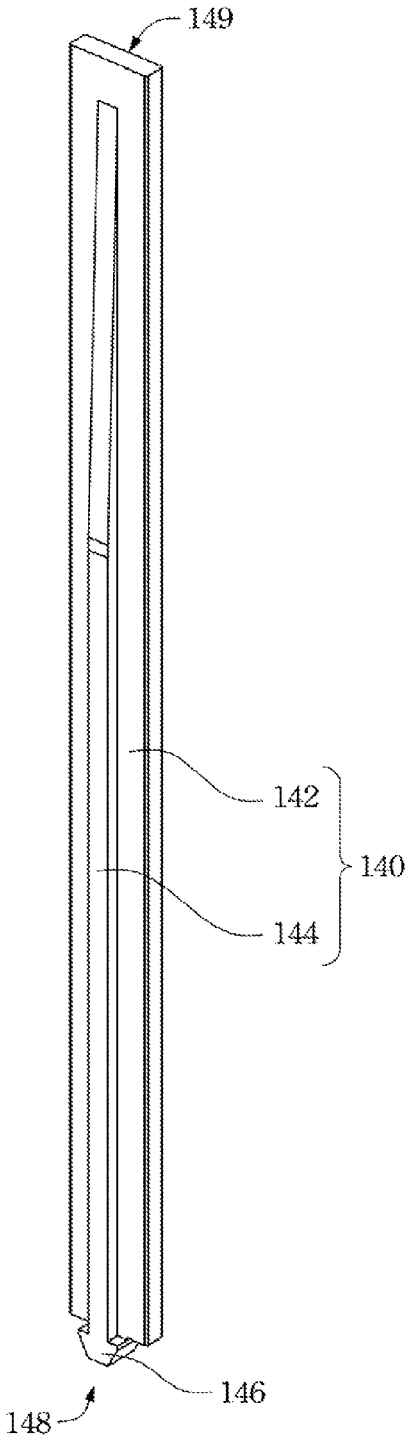
FIG. 3 is a perspective view of the light guide pillar shown in FIG. 2.
Figure 4:
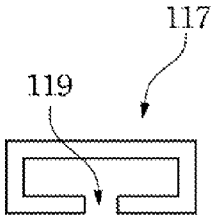
FIG. 4 is a top view of the accommodating groove shown in FIG. 2.

FIG. 3 is a perspective view of the light guide pillar 140 shown in FIG. 2, FIG. 4 is a top view of the accommodating groove 117 shown in FIG. 2. As shown in FIG. 1A, FIG. 3, and FIG. 4, the light guide pillar 140 includes a light inlet surface 148 and a light outlet surface 149 opposite to the light inlet surface 148. The light guide pillar 140 includes a pillar 142 and an oblique protruding rib 144. The accommodating groove 117 further includes an opening groove 119 facing the fan body 130. The pillar 142 is disposed in the accommodating groove 117. The oblique protruding rib 144 is disposed on a side of the pillar 142 and protrudes out of the opening groove 119 for positioning the light guide pillar 140. In this embodiment, the light inlet surface 148 and the light outlet surface 149 are formed with the oblique protruding rib 144 and the pillar 142 in common. Thickness of the oblique protruding rib 144 adjacent to the light inlet surface 148 is larger than thickness of the oblique protruding rib 144 adjacent to the light outlet surface 149, so that an area of the light outlet surface 149 is smaller than an area of the light inlet surface 148. In practice, when the area of the light outlet surface 149 is smaller than the area of the light inlet surface 148, the light outlet surface 149 would have better focus capability. Therefore light intensity would be improved and users can judge the operating statuses of the fan device 100 more easily, such as an indicator light.

Figure 5A:
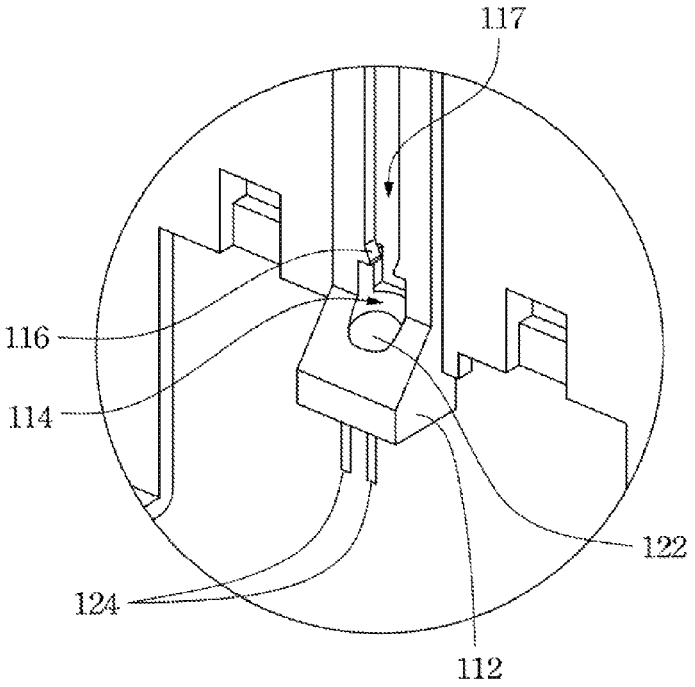
FIG. 5A is a partial enlargement view of the light holder shown in FIG. 2.

FIG. 5A is a partial enlargement view of the light holder 112 shown in FIG. 2. As shown in FIG. 3 and FIG. 5A, the housing 110 includes a light holder 112 disposed at the end of the accommodating groove 117 adjacent to the fixing cover 150. The light holder 112 includes a hole 114 therein. The light source 122 is fixed in the light holder 112 and is exposed by the hole 114. A light emitting surface of the light source 122 is disposed to face the accommodating groove 117. The housing 110 may further include a flexible fastener 116 disposed on the accommodating groove 117 adjacent to the light inlet surface 148. The oblique protruding rib 144 may further include a fastening portion 146 coupling to the flexible fastener 116. In such design, the light guide pillar 140 would be fixed in the accommodating groove 117 more firmly.

Figure 5B:
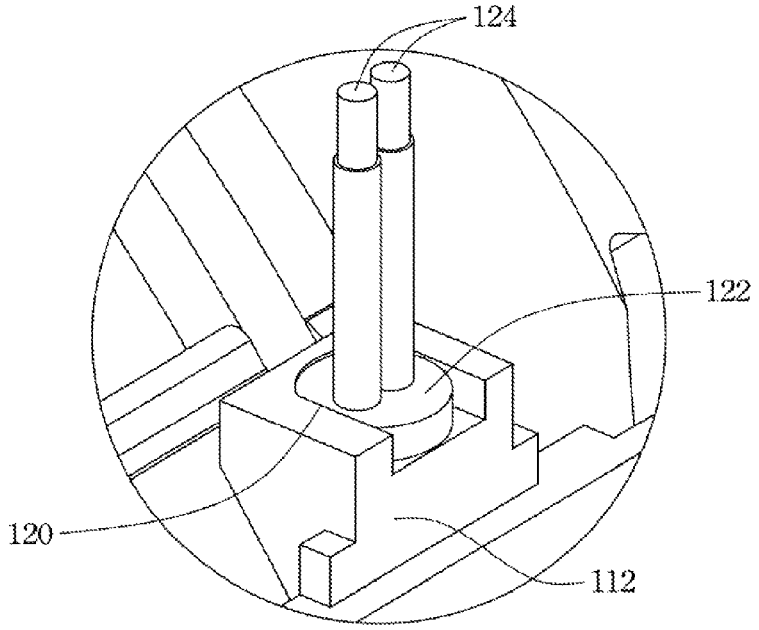
FIG. 5B is a partial enlargement view of the light source shown in FIG. 1A.

FIG. 5B is a partial enlargement view of the light source 122 shown in FIG. 1A, as shown in FIG. 1A and FIG. 5B. A bottom surface of the light source 122 is illustrated in FIG. 5B. The electric wire 124 of the bottom surface of the light source 122 is electrically connected to the connector 154 of the fan device 100 for receiving necessary power of the light source 122. In addition, a back surface of the light source 122 may be a specific shape corresponding to a shape of a contacting surface 120 of the light holder 112. For example, a shape including a plane and an arc surface would couple the light source 122 on the light holder 112, so that the light source 122 would not shift in horizontal directions on the light holder 112. The fixing cover 150 may further include a supporting portion 170. When the fixing cover 150 is assembled to the housing 110, the supporting portion 170 would be in contact with a part of the back surface of the light source 122 for fixing the light source 122 on the light holder 112. Therefore the light source 122 would not shift in vertical directions on the light holder 112. In such design, the light source 122 can be fixed on the light holder 122 firmly in horizontal and vertical directions.

Return to FIG. 1A, the fan device 100 may further include a flexible body 160 and a fixing element 162. The flexible body 160 is disposed between the housing 110 and the fan body 130. The fixing element 162 is used for fixing the flexible body 160 between the housing 110 and the fan body 130. Materials of the flexible body 160 may include sponge or rubber, and the flexible body 160 is a rubber plate in a preferred embodiment. The fixing element 162 may be a bolt. In this embodiment, the flexible body 160 is disposed between the housing 110 and the fan body 130, such as four corners of the housing 110. The flexible body 160 would be fixed between the housing 110 and the fan body 130 by utilizing the fixing element 162 penetrating through a central hole of the flexible body 160, thereby the fan body 130 would not be in contact with the housing 110 directly. Therefore noise generated from the operating fan device 100 due to vibration would be reduced.

The fan device 100 not only may be disposed in an electric apparatus, but also may be disposed in an assembling frame housing to form a fan assembly. The contents described in the above embodiments would not be described repeatedly in following descriptions, and only illustrate embodiments related to the fan assembly.

Figure 7:
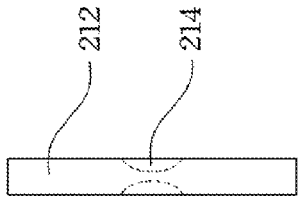
FIG. 7 is a front view of the partition board shown in FIG. 6.
Figure 6:
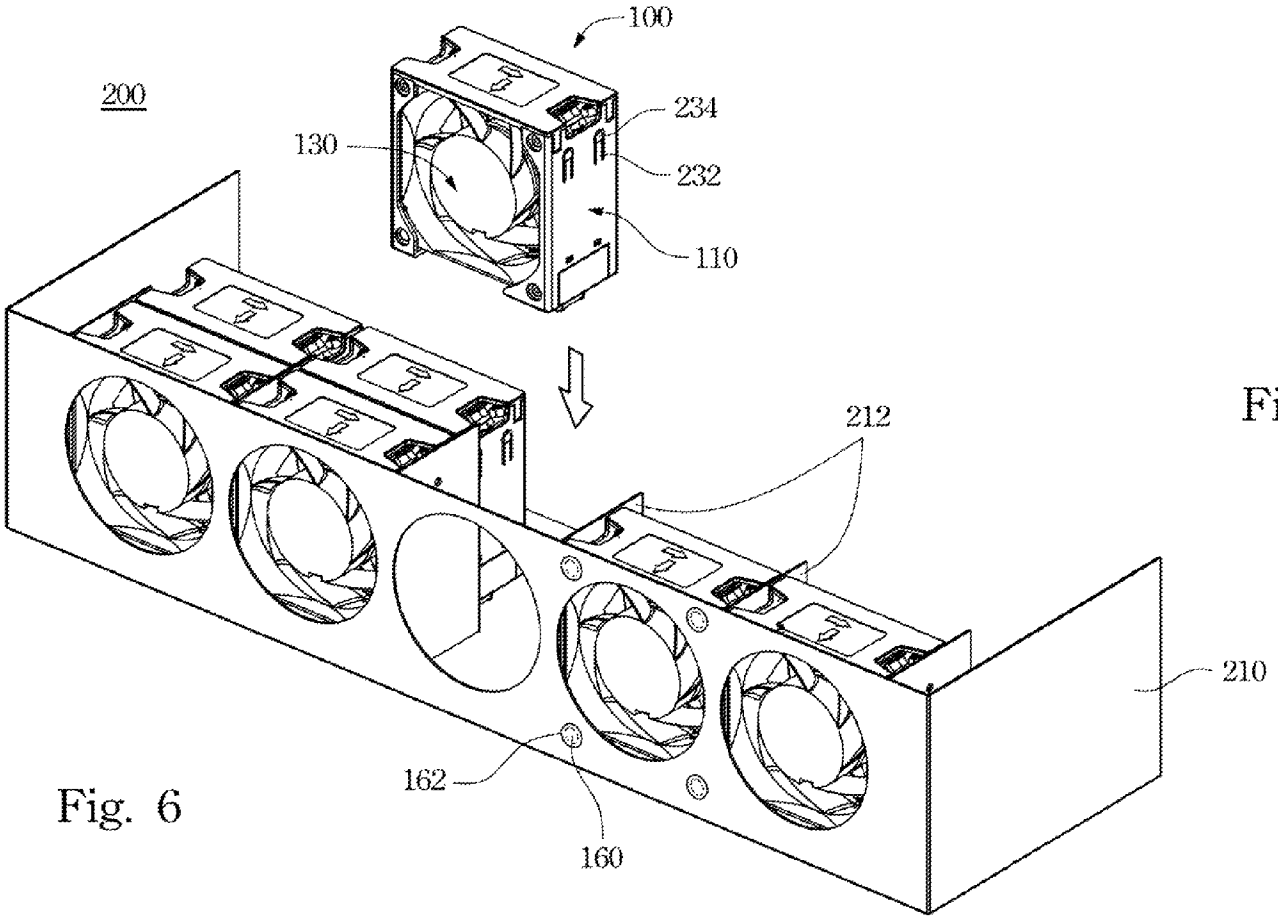
FIG. 6 is a perspective view of a fan assembly of another embodiment of the present invention.

FIG. 6 is a perspective view of a fan assembly 200 of another embodiment of the present invention, and FIG. 7 is a front view of the partition board 212 shown in FIG. 6. The housing 110 of the fan device 100 further includes a flexible arm 232. The flexible arm 232 includes a protruding portion 234 facing away from the fan body 130. The flexible arm 232 is integrally formed with the housing 110, so that the housing 110 includes a through hole 132 (shown in FIG. 1C) corresponding to the flexible arm 232. The flexible arm 232 is accommodated in the through hole 132 and is integrated formed with the housing 110. The fan assembly 200 includes a frame housing 210, a partition board 212, and the fan device 100 mentioned above. The partition board 212 is disposed in the frame housing 210 and includes an opening 214. The fan device 100 is disposed in the frame housing 210. The protruding portion 234 is coupled to the opening 214.

In this embodiment, these partition boards 212 are in a parallel arrangement. Every partition board 212 includes the opening 214, such as a concave or a through hole. Because the housing 110 of the fan device 100 includes the flexible arm 232 and the protruding portion 234 of the flexible arm 232 corresponds to position and geometric shape of the opening 214 of the partition board 212, the protruding portion 234 would be coupled to the opening 214. Thus, the fan device 100 can be detachably assembled between the two partition boards 212.

In addition, the flexible body 160 and the fixing element 162 may be applied to a contacting region between the frame housing 210 and the housing 110, and the protruding portion 234 of the flexible arm 232 of the housing 110 mentioned above can be coupled to the opening 214 of the partition board 212. Therefore the whole fan assembly 200 would have vibration proof capability for reducing noise due to vibration.

Size of the frame housing 210, numbers of the partition board 212 and the fan device 100 may be designed in accordance with practical requirements. Numbers and positions of the opening 214 of the partition board 212 and the protruding portion 234 of the housing 110 may also be changed depending on designers' design. For example, the partition board 212 includes five openings 214, and the housing 110 includes three protruding portions 234 adjacent to a side of the partition board 212. The three protruding portions 234 correspond to three of the five openings 214 respectively. Another housing 110 includes two protruding portions 234 adjacent to another side of the partition board 212. The two protruding portions 234 correspond to the other two of the five openings 214 respectively. In such design, the two fan devices 100 can utilize one partition board 212 in common.

The embodiments mentioned above of the present invention compared with conventional structures have some advantages described below:

(1) Because the fan device includes the detachable fixing cover, the fixing cover can be changed in accordance with different types of the connectors of the fan body. Users do not need to change or produce different housings to fit different types of the connectors, so that the fan device would reduce manufacturing cost and save manufacturing time.

(2) The housing of the fan device includes the accommodating groove and the light holder disposed on the internal wall of the housing respectively. The electric wire disposed on the bottom surface of the light source is adjacent to the fixing cover of the fan device, so that the light source would be electrically connected to the connector for receiving electric power generated from external apparatuses conveniently.

(3) The back surface of the light source is a specific shape corresponding to a shape of the contacting surface of the light holder, so that the light source would not shift in horizontal directions on the light holder. In addition, when the fixing cove is assembled to the housing, the supporting portion of the fixing cover would be in contact with a part of the back surface of the light source, so that the light source would be supported by the light holder and would not shift in vertical directions on the light holder. In such design, the light source can be fixed on the light holder firmly in horizontal and vertical directions.

(4) The fan device utilizes the fixing element to fix the flexible body between the fan body and the housing. The fan assembly utilizes the fixing element to fix the flexible body between the housing of the fan device and the frame housing of the fan assembly. The protruding portion of the flexible arm of the housing is coupled to the opening of the partition board of the frame housing. Thus, the fan device and the fan assembly can reduce noise due to vibration.

The readers attention is directed to all papers and documents which are filed concurrently with his specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A fan device comprising:

a housing;

a fan body disposed in the housing;

a connector electrically connected to the fan body; and a fixing cover detachably assembled to the housing, wherein the fixing cover is disposed on a corner of the housing, and the fixing cover comprises:

a connecting structure fitting a type of the connector for positioning the connector on the fixing cover and partially exposing the connector to an outside of the fan body;

a first board, wherein the first board is rectangular and is connected to the housing with at least three sides of the first board; and a second board, wherein the first board and the second board are vertically arranged with each other, and the second board is rectangular and is connected to the housing with at least three sides of the second board;

wherein the first board is coupled to a first surface of the housing to form a first plane, and the second board is coupled to a second surface of the housing to form a second plane, the first board comprises at least one first hook for being coupled to at least one first groove of the first surface, and the second board comprises at least one second hook for being coupled to at least one second groove of the second surface.

2. The fan device as claimed in claim 1, wherein the fan body comprises a fan frame, an impeller accommodated in the fan frame, a motor for driving the impeller to rotate, a bottom portion for supporting the motor, and a plurality of connecting members for connecting the fan frame and the bottom portion; the fan frame comprises a wind inlet side and a wind outlet side, and the connecting members are disposed on the wind outlet side of the fan frame.

3. The fan device as claimed in claim 2, wherein the housing comprises a wind inlet opening and a wind outlet opening corresponding to the wind inlet side and the wind outlet side of the fan body respectively, and the housing comprises at least one protecting rib disposed on the wind inlet opening.

4. The fan device as claimed in claim 1, further comprising:

an accommodating groove disposed on an internal wall of the housing;

a light source disposed at an end of the accommodating groove adjacent to the fixing cover; and a light guide pillar disposed in the accommodating groove.

5. The fan device as claimed in claim 4, wherein the light guide pillar comprises a light inlet surface and a light outlet surface opposite to the light inlet surface, and an area of the light outlet surface is smaller than an area of the light inlet surface.

6. The fan device as claimed in claim 4, wherein the accommodating groove comprises an opening groove facing the fan body, and the light guide pillar comprises:

a pillar disposed in the accommodating groove; and an oblique protruding rib disposed on a side of the pillar and protruding out of the opening groove.

7. The fan device as claimed in claim 6, wherein the housing comprises a flexible fastener, and the oblique protruding rib comprises a fastening portion coupling to the flexible fastener.

8. The fan device as claimed in claim 4, wherein the housing comprises a light holder disposed at the end of the accommodating groove adjacent to the fixing cover, the light holder comprises a hole therein; the light source is fixed in the light holder and is exposed by the hole.

9. The fan device as claimed in claim 8, wherein the fixing cover further comprises a supporting portion being in contact with the light source for fixing the light source in the light holder.

10. The fan device as claimed in claim 1, further comprising:

a flexible body; and a fixing element for fixing the flexible body between the housing and the fan body.

11. The fan device as claimed in claim 10, wherein the flexible body is a rubber plate or a sponge, and the fixing element is a bolt.

12. The fan device as claimed in claim 1, wherein the housing comprises a flexible arm, and the flexible arm comprises a protruding portion facing away from the fan body.

13. The fan device as claimed in claim 12, wherein the housing comprises a through hole corresponding to the flexible arm, and the flexible arm is accommodated in the through hole and is integrated with the housing.

14. The fan device as claimed in claim 1, wherein the connecting structure is an opening hole or a concave groove.

15. A fan assembly comprising:

a fan device comprising:

a housing;

a fan body disposed in the housing;

a connector electrically connected to the fan body; and a fixing cover detachably assembled to the housing, wherein the fixing cover is disposed on a corner of the housing, and the fixing cover comprises:

a connecting structure fitting a type of the connector for positioning the connector on the fixing cover and partially exposing the connector to an outside of the fan body;

a first board, wherein the first board is rectangular and is connected to the housing with at least three sides of the first board; and a second board, wherein the first board and the second board are vertically arranged with each other, and the second board is rectangular and is connected to the housing with at least three sides of the second board;

wherein the first board is coupled to a first surface of the housing to form a first plane, and the second board is coupled to a second surface of the housing to form a second plane, the first board comprises at least one first hook for being coupled to at least one first groove of the first surface, and the second board comprises at least one second hook for being coupled to at least one second groove of the second surface;

a frame housing; and a partition board disposed in the frame housing and comprising an opening, wherein the fan device is disposed in the frame housing; the frame housing comprises a flexible arm comprising a protruding portion; the protruding portion faces away from the fan body and is coupled to the opening.

* * * * *